United States Patent [19]

Widrow et al.

[11] Patent Number: 4,751,738

[45] Date of Patent: Jun. 14, 1988

[54] DIRECTIONAL HEARING AID

[75] Inventors: Bernard Widrow, Stanford, Calif.; Maurice N. Brearley, Williamstown, Australia

[73] Assignee: The Board of Trustees of the Leland Stanford Junior University, Stanford, Calif.

[21] Appl. No.: 676,414

[22] Filed: Nov. 29, 1984

[51] Int. Cl.[4] ..... H04R 25/00; H04R 1/20; H04R 1/24; H04R 3/04

[52] U.S. Cl. ..... 381/68.1; 381/68.2; 381/68.5

[58] Field of Search ..... 179/107 FD, 107 R, 107 S, 179/182 R; 381/68, 69, 68.1–68.2, 68.4–68.5; 181/129, 130

[56] References Cited

U.S. PATENT DOCUMENTS

| | | | |
|---|---|---|---|
| 3,458,668 | 1/1969 | Hassler | 381/68.1 |
| 3,946,168 | 3/1976 | Preves | 381/68.1 |
| 3,975,599 | 8/1976 | Johanson | 381/68.1 |
| 4,456,795 | 1/1984 | Saito | 381/68.2 |

FOREIGN PATENT DOCUMENTS

| | | | |
|---|---|---|---|
| 2340894 | 2/1975 | Fed. Rep. of Germany | 179/107 FD |
| 2344554 | 3/1975 | Fed. Rep. of Germany | 179/107 FD |
| 3133107 | 3/1983 | Fed. Rep. of Germany | 179/182 R |
| 2236968 | 2/1984 | Fed. Rep. of Germany | 179/107 FD |
| 2323437 | 11/1984 | Fed. Rep. of Germany | 179/107 FD |

OTHER PUBLICATIONS

Brearley et al, "A Hearing Aid for Use in the Presence of Background Noise", Australasian Physical & Engineering Sciences in Medicine, vol. 4, No. 3, (1981).

*Primary Examiner*—Jin F. Ng
*Assistant Examiner*—Danita R. Byrd
*Attorney, Agent, or Firm*—Flehr, Hohbach, Test, Albritton & Herbert

[57] ABSTRACT

A pair of sensitive microphones or transducers are mounted on a user's body, spaced apart by a distance equal to one-half a wavelength of the center frequency of a range of frequencies to be emphasized. By summing the outputs of the two microphones, sound in the broadside or look direction (i.e., the direction the listener faces, the microphones being on a line perpendicular to this direction) are emphasized; sounds in the endfire or side directions are nulled or produce a substantially null response in the region of the center frequency defined by the microphone spacing. A third microphone may be added that is not equally spaced from the microphones on either side, but is spaced to provide half wavelength distances which define maximum and null responses centered at the other points within the frequency range (1–4 KHz) desirable for highly effective hearing. The summed signal from each mircophone pair is bandpass filtered. Three bandpass filters are used. The centers of their pass bands are 1200 Hz, 2250 Hz, and 3600 Hz, respectively. Thus each microphone pair and associated bandpass filter is responsible for providing a directonal receiving capability in its assigned range of frequencies. The frequency ranges are contiguous and overlap slightly. The final output is obtained by summing and amplifying the bandpass filter outputs. A good bandpass filter design is a fourth order Butterworth filter, whose center frequency can be designed to be:

$$F_c(\text{center frequency}) = \frac{\text{Sound Speed}}{2 \times \text{microphone separation}}$$

7 Claims, 2 Drawing Sheets

DIRECTIONAL HEARING AID

FIELD OF THE INVENTION

This invention relates generally to a hearing aid and more particularly to a directional hearing aid which both emphasizes sound in the look direction and minimizes sound coming from the sides and the rear.

BACKGROUND OF THE INVENTION

It has been found that under certain circumstances and for persons with a particular but not unusual type of hearing defect, that a hearing aid providing good, directional response is very desirable. People whose hearing handicap is that they are deaf in one ear but have at least some minimal level of hearing in the other ear find it very difficult to tune into and understand a particular speaker or sound source in the presence of other background noise sources. Persons with such a single ear hearing loss are able to hear with their good ear, but are unable to differentiate and separate the sounds from various sources. In other words, they are able to hear but not to understand. This phenomenon is known as the "cocktail party" effect it makes it extremely difficult for a mono-aurally handicapped person to participate effectively in a situation with multiple sound sources such as at a group discussion or at a cocktail party.

Among the devices proposed in the prior art, and currently commercially available, one which has achieved some popularity and is known as the cross-aid device. This device consists basically of a subminiature microphone located on the user's deaf side, with the amplified sound piped into the good ear. While this compensates for deafness on one side, it is not very effective in reducing the cocktail party problem. Other efforts in the prior art have been largely directed to the use of moving, rotatable conduits which can be turned in the direction which the listener wishes to emphasize (see for example U.S. Pat. No. 3,983,336). Alternatively, efforts have also been made in using movable plates and grills to change the acoustic resistance and thus the directive effect of a directional hearing aid (see U.S. Pat. No. 3,876,843 Moen). None of these efforts have proved to be satisfactory. Old-fashioned ear trumpets has been effective in providing amplification and directionality, but they went out of favor with the advent of electronic hearing aids.

SUMMARY OF THE INVENTION

It is an object of the present invention to overcome the prior art problems by providing a subminiature microphone array which can be mounted on a spectacle-like frame to provide improved bearing response in the look direction. The invention would allow the user to wearer to tune into a speaker merely by turning his head to face the audio source of interest.

It is well known that the frequencies of greatest interest in providing a usable hearing aid lie between 1,000 and 4,000 Hz. The inventors herein have observed that an analogy exists between a pair of ears and a two element array of microphones in terms of beam forming capabilities. That is, two microphones which are placed apart approximately the width of a pair of spectacles, which is equivalent to the width of a listener's ears, lie approximately 13 cm. apart. This distance corresponds to a half wave length for an audio signal of 1,384 Hz, a key frequency in the range of 1–4 KHz, useful for speech intelligibility. The signals from the two microphones are summed. The result is that sounds in the range of 1400 Hz which are received head on, i.e. substantially perpendicular to the line on which both microphones lie, are reinforced and emphasized by the addition process. But speech of the same frequency received from the side reaches first one microphone and then almost exactly one-half cycle later reaches the other microphone. The result of adding the outputs of the two microphones together is effectively substantial cancellation of the contributions of the two microphones at that frequency.

Thus, the invention resides in the use of a pair or plurality of pairs of sensitive microphones or transducers spaced apart by a distance equal to one-half a wave length of the center frequency of a range of frequencies to be emphasized. By summing the outputs of the two microphones, sound in the broadside or look direction (i.e. the direction the listener faces, the microphones being on a line perpendicular to this direction) are emphasized; sounds in the end fire or side directions are nulled or produce a substantially null response in the region of the center frequency defined by the microphone spacing.

In an especially useful embodiment, at least a third microphone is added which is not equally spaced from the microphones on either side but rather is spaced to provide half wave length distances which define maximum and null responses centered at other points within the frequency range (1–4 KHz) desirable for highly effective hearing. Thus, by deploying a third microphone which is 5 cm. from the microphone on one side and 8 cm. from the microphone on the other side, two further pairs of microphones can be defined. The pair of microphones which are spaced 5 cm. apart will have a summed output in the broadside direction which emphasizes a frequency of about 3600 Hz; a pair of microphones spaced 8 cm. apart will have an output when added together emphasizing a frequency range centered about 2250 Hz. Thus, by emphasizing frequencies according to the spacings discussed of about 1390 Hz; 2250 Hz; and 3600 Hz, the entire auditory range can be covered in 3 steps. The summed signal from each microphone pair is bandpass filtered. Three bandpass filters are used. The centers of their pass bands are 1390 Hz, 2250 Hz, and 3600 Hz respectively. Thus each microphone pair and associated bandpass filter is responsible for providing a directional receiving capability in its assigned range of frequencies. The frequency ranges are contiguous and overlap slightly. The final output is obtained by summing and amplifying the bandpass filter outputs. In this way, the entire system has an approximately uniform frequency response in the look direction and low responses at end fire.

A good bandpass filter design has been found to be a fourth order Butterworth filter, having center frequency at substantially the point defined by the equation:

$$F_c \text{ (central frequency)} = \frac{\text{Sound Speed}}{2 \times \text{microphone separation}}$$

It has further been found to be especially useful to invert the output of the bandpass filter connected to the pair of microphones which define the center of the three pairs of frequencies, resulting in a more linear phase response for the overall system in the look direction.

BRIEF DESCRIPTION OF THE DRAWINGS

The subject invention will be more fully explained with respect to the accompanying figures wherein.

Figure 1:
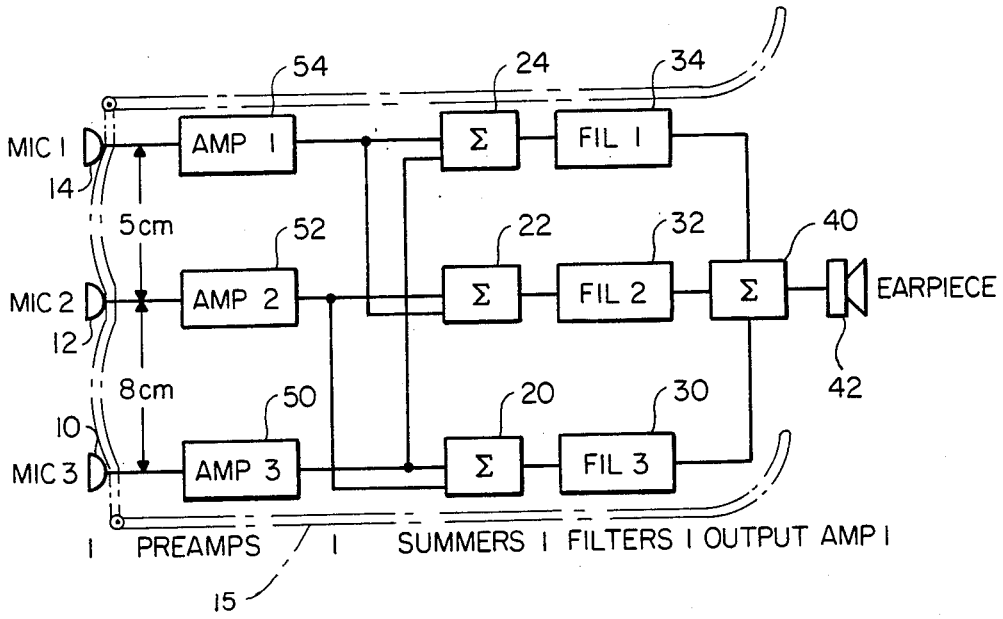
FIG. 1 comprises a schematic diagram of the essential electronic elements coupled between the microphone array and earpiece for the wearer.

A typically useful microphone array is shown in FIG. 1. It comprises three microphones, 10, 12, and 14 which are mounted unequally spaced on the user's spectacles 15 or on some other support structure. The microphone array is substantially perpendicular to the direction in which the wearer is looking. The spacings of the three microphones are chosen to define center frequencies ($F_c$) according to the equation:

$$\text{Microphone Separation} = \frac{\text{Sound Speed}}{2 \times F_c}$$

In this way the useful audio band between 1 KHz and 4 KHz is divided into three sections. The sound received from the forward or look direction of the user at or about each center frequency is to be emphasized by a pair of microphones whose outputs are summed in summing devices 20, 22, 24 and filtered through bandpass filters 30, 32, 34. The bandpass filters, which may be two-stage fourth-order Butterworth bandpass filters of a type well known in the electronics arts, have frequencies centered on the frequencies defined by the equation:

$$F_c = \frac{\text{Sound Speed}}{2 \times \text{Microphone separation}}$$

By following this equation, if microphones 10 and 14 are separated by 13 cm., then a center frequency for filter 30 is defined at about 1384 Hz. The spacing of microphones 10 and 12 leads to a center frequency being defined at about 2250 Hz, that is the half wave length of 8 cm. The two closest microphones, 12 and 14 can be about 5 cm. apart, establishing a center frequency of about 3400 Hz for the highest bandpass filter 34.

Figure 3:
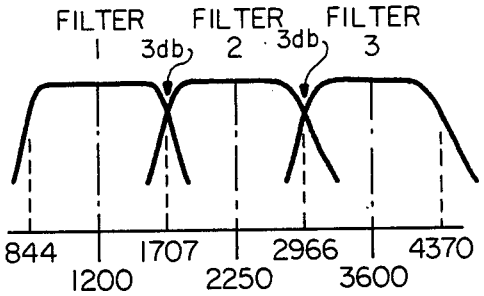
FIG. 3 is a representation of the bandpass filter output responses which, when summed together, are used to emphasize the sound frequency spectrum between 1 and 4 KHz in the look direction.

The frequency response outputs and minus 3 DB points of the bandpass filters are shown in exemplary fashion in FIG. 3; when summing these responses this graph of FIG. 3 roughly represents the output of the summing device 40 which receives the outputs of the three filters 30, 32, 34 and provides the summed amplified output to the wearer's earpiece 42. The center frequencies of each of the filters, and thus the spacing of the microphones was chosen to provide approximately the same Q factor (ratio of center frequency to band width), with overlapping at the minus 3 DB points, for each of the three filter channels.

Figure 2:
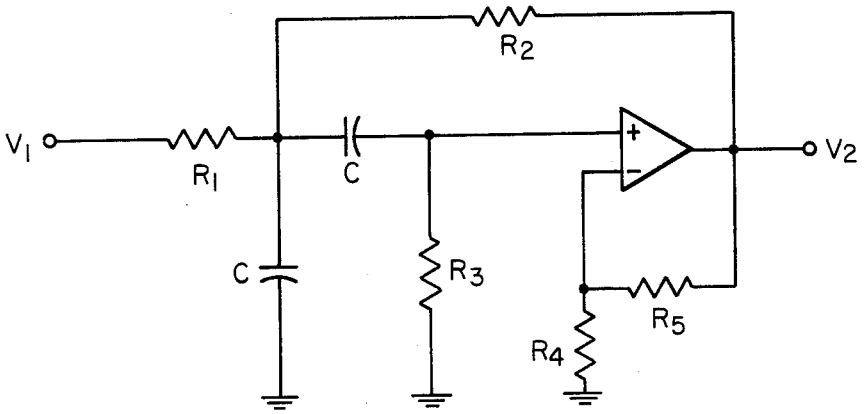
FIG. 2 comprises a schematic diagram of one stage of a filter useful to define the bandpass filters used in the system of FIG. 1.

Turning briefly to the specifics of the circuitry connected to the outputs of each microphone, the amplifiers 50, 52, 54 are of a standard design such as is well known in the hearing aid industry. The outputs of the amplifiers are paired by the summers 20, 22, 24 so that each pair of microphones has its outputs combined to define a center frequency of maximum amplification for sound received directly from the front or in the look direction, and maximum cancellation when received from the broadside directions. Low sensitivity to sounds from the rear of the head is a result of shadowing by the head. The outputs of the summers are applied to a two-stage Butterworth filter, the details of each filter stage being shown in FIG. 2. The outputs of these filters comprise bandpass outputs centered at about 1390 Hz; 2250 Hz; and 3600 Hz. As noted previously, the output of the center filter, filter 32, is inverted in phase by 180°. The result of this invention is minimization of frequency rolloffs at points midway between the center filter output 32 and the outputs of filters 30, 34.

In an alternative embodiment, the microphone preamplifiers 50, 52, 54 are designed as log amplifiers instead of linear amplifiers. This would provide logarithmic gain of the output of the preamplifier so that the loud sound coming from just below the array of microphones, i.e. from the speaker himself, would not be amplified as much as weaker sounds from speakers at a distance.

Figure 4:
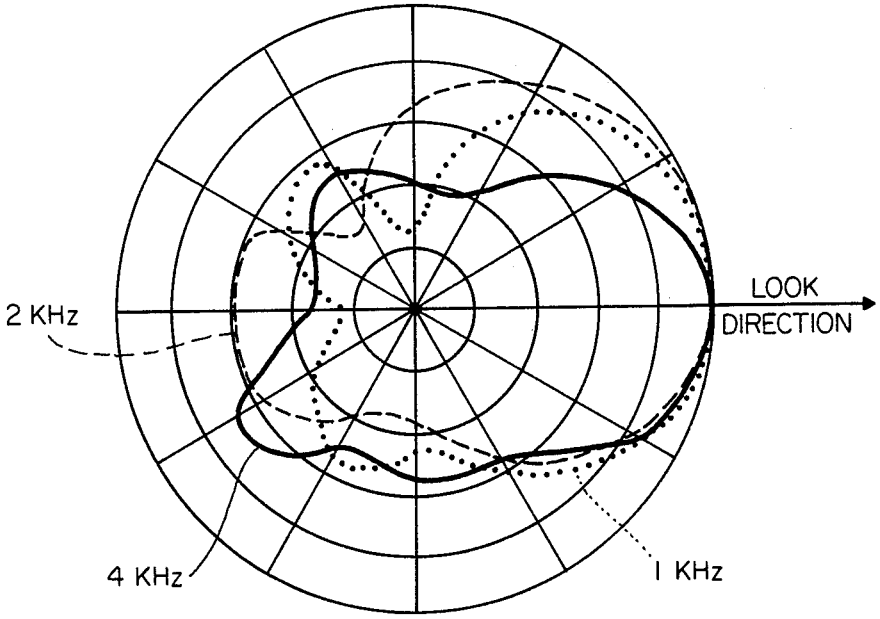
FIG. 4 shows plots of the effectiveness and measured overall responses of a three microphone array in emphasizing sound in the look direction, while minimizing sound coming from the broadside direction and the direction to the rear of the wearer. Directivity patterns are plotted at three frequencies in the audiable range.

With these factors in mind, significantly improved hearing in the "look" direction can be achieved with the subject invention. The response patterns of FIG. 4 indicate a significant gain in receptiveness at all frequencies in the look direction and significantly attenuated responses at all frequencies in the broadside or endfire directions. The frequency attenuation to the rear is due to the fact that the head of the wearer shadows the sounds which would otherwise be received by the microphones. Furthermore, the microphones themselves could have directivity patterns. Cardiod microphones which were insensitive in the rearward direction were used in the system represented in FIG. 4.

This directional effect is typically highly desirable in order that the user can focus his attention on sounds in the look direction. The system is otherwise extremely easy to use and relatively simple to expand upon. That is, by adding further microphones, the filters of narrower band width, the audio band can be broken up into narrower segments and even greater fidelity in the look direction can be achieved as well as an expanded bandwidth. More perfect nulling in the side direction at all the audio frequencies can also be achieved. Four microphones appropriately spaced would allow the audio band to be divided into six segments. The number of segments is equal to the number of possible combinations of the chosen number of microphones taken two at a time.

Other modifications and improvements may occur to one of skill in the art who studies the foregoing patent application; therefore the scope of the present invention is to be limited only by the following claims.

What is claimed:

1. A directional hearing aid to be worn on a user having electronic means to emphasize sounds of a frequency of interest to said user arriving in a direction forward of the user and attenuate sounds arriving from a side of the user at said frequency of interest, comprising a microphone array comprising more than two microphones disposed along a line perpendicular to said forward direction of arrival of sound, the spacing between each pair of said microphones being different, said microphone spacing of each said pair defining a different half wavelength distance to provide signal receivers tuned to different portions of the frequency band whereby the combination of the summed outputs of said pairs provides a wider spectrum of sound emphasis than a single one of said pairs, means for summing outputs of the microphone of each said pair of microphones, bandpass filter means for bandpass filtering the output of the summing means, the center frequency of the bandpass filter means being defined as $$F_c = \frac{\text{Sound Speed}}{2 \times \text{microphone separation}}$$

whereby the spacing between the microphones is one-half wavelength of the frequencies passed by the filter, and means for conveying the outputs of said bandpass filter means to an ear of the user.

2. The hearing aid of claim 1 wherein said microphones include first, second and third microphones disposed along said line, a distance from said first microphone to said second microphone being different from the distance between said second microphone and said third microphone, the outputs of said first and second, second and third, and first and third microphones being summed to define first, second and third pairs of said microphones respectively spaced apart by respective first, second and third unequal distances to emphasize a range of frequencies.

3. The hearing aid of claim 2 wherein said means for summing the outputs of the pairs of microphones and bandpass filter means having a different center frequency $F_c$ for filtering the output of each of said summing means.

4. The hearing aid of claim 3 wherein said amplifying means comprise output summing means for summing the outputs of said band-pass filter means, said output summing means being coupled to an earpiece for the user.

5. A directional hearing aid comprising a plurality of microphones, each two microphones of said plurality being coupled to form a microphone pair, said microphones being arrayed on a user along a line substantially perpendicular to a direction of arrival of sound, each pair of said microphones being separated by a distance different from the spacing of any other pair, summing means coupled to outputs of each said pair of microphones for summing the output of each said microphone of said pair of microphones, means for bandpass filtering the output of said summing means, the center frequency of said bandpass filter means being defined by the relationship $$F_c = \frac{\text{Sound Speed}}{2 \times \text{microphone separation}}$$

combining means for summing the outputs of said bandpass filter means, and means for conveying the output of said combining means to an ear of the user.

6. A method of improving the hearing of a user of a directional hearing aid of sounds received from a source forward of the user within a given frequency range while minimizing sound within the same frequency range from sources broadside to the user, comprising aligning an array of microphones on a user of said hearing aid substantially perpendicular to a direction forward of the user, the microphones being laterally separated, selectively combining the outputs of said microphones to emphasize different frequency bands of interest based on the physical separation of said microphones, filtering each of said combined microphone outputs through a bandpass filter centered on a frequency $F_c$ defined as:

$$F_c = \frac{\text{Sound Speed}}{2 \times \text{microphone separation}},$$

summing the outputs of said filters and conveying the result of said summing step to an ear of the user.

7. A method as claimed in claim 6 wherein at least one of said frequencies $F_c$ is about 1390 Hz, a second one of said frequencies is about 3600 Hz, and a third frequency is intermediate said first and second frequencies.

* * * * *